US008686266B2

(12) United States Patent
Taniguchi

(10) Patent No.: US 8,686,266 B2
(45) Date of Patent: Apr. 1, 2014

(54) KEYBOARD DEVICE

(75) Inventor: Hirokazu Taniguchi, Tachikawa (JP)

(73) Assignee: Casio Computer Co., Ltd., Tokyo (JP)

( * ) Notice: Subject to any disclaimer, the term of this patent is extended or adjusted under 35 U.S.C. 154(b) by 201 days.

(21) Appl. No.: 13/288,113

(22) Filed: Nov. 3, 2011

(65) Prior Publication Data

US 2012/0111176 A1 May 10, 2012

(30) Foreign Application Priority Data

Nov. 5, 2010 (JP) ..... 2010-248307

(51) Int. Cl.
*G10C 3/12* (2006.01)

(52) U.S. Cl.
USPC ..... 84/433

(58) Field of Classification Search
USPC ..... 84/433
See application file for complete search history.

(56) References Cited

U.S. PATENT DOCUMENTS 4,418,605 A * 12/1983 Tollefsen et al. ..... 84/434

FOREIGN PATENT DOCUMENTS

JP 05-011747 A 1/1993

* cited by examiner

*Primary Examiner* — Jianchun Qin
(74) *Attorney, Agent, or Firm* — Holtz, Holtz, Goodman & Chick, PC

(57) ABSTRACT

The present invention includes a keyboard chassis 1; keys 2 which are arranged on the keyboard chassis 1 and rotate in an up and down direction by bending a bendable section 22 positioned in the rear; and a key rotation holding section 30 for holding the rotation fulcrum of a key 2 stable when it rotates in the up and down direction. Accordingly, the rotation fulcrum of the key 2 is kept stable by a first supporting section 31 and a second supporting section 32 of the key rotation holding section 30 when the key 2 is depressed and the bendable section 22 bends in the up and down direction, whereby the key 2 is stably rotated. Therefore, regardless of whether the front portion of the key 2 is being depressed or the rear portion thereof is being depressed, the rotation movement of the key 2 will always remain stable.

2 Claims, 5 Drawing Sheets

KEYBOARD DEVICE

CROSS-REFERENCE TO RELATED APPLICATION

This application is based upon and claims the benefit of priority from the prior Japanese Patent Application No. 2010-248307, filed Nov. 5, 2010, the entire contents of which is incorporated herein by reference.

BACKGROUND OF THE INVENTION

1. Field of the Invention

The present invention relates to a keyboard device used in a keyboard instrument such as an electronic piano or an electronic organ.

2. Description of the Related Art

Conventionally, a keyboard device such as an electronic piano is known where the keys provided on a keyboard chassis have a thin bendable section that bends in an up and down direction and rotate in the up and down direction by bending the bendable section, and hammer members are rotatably provided on the keyboard chassis that apply action load to the keys in response to key pushing operations, as described in Japanese Patent Application Laid-Open (Kokai) Publication No. 05-011747.

In a keyboard device such as this, when the front portion of a key is depressed by a key pushing operation, the key rotates such that its rear portion rises and a portion of the key comes in contact with the hammer member as a fulcrum. Accordingly, the bendable section is pressed upward by the key and bends thereby. On the other hand, when the rear portion of the key is depressed, the key rotates such that the rear portion is lowered and a portion of the key comes in contact with the hammer member as a fulcrum. Accordingly, the bendable section is pressed downward and bends thereby. As a result of this structure, the bendable section significantly bends in the up and down direction according to a depressed portion of the key. Therefore, there is a problem in that repeated stress concentration on the bendable section causes the bendable section to become damaged.

For this reason, in order to prevent damage to the thin bendable section provided in the key, the conventional keyboard device has a structure in which an upper deformation restricting section that restricts elastic deformation of the bendable section in the upward direction and a lower deformation restricting section that restricts elastic deformation of the bendable section in the downward direction are provided on portions of the key that are positioned to the front of the bendable section. A portion of the upper deformation restricting section and a portion of the lower deformation restricting section which comes in contact with the keyboard chassis are formed on the key so as to be shifted from each other in the front-back direction of the key.

In a keyboard device such as this, when the front portion of a key is depressed, the rear portion of the key is pressed upwards with a portion of the key in contact with the hammer member as a fulcrum, and so the upper deformation restricting section of the key comes in contact with the undersurface of the keyboard chassis, whereby the upward elastic deformation of the bendable section is restricted. Also, when the rear portion of the key is depressed, the rear portion of the key is pressed downwards with a portion of the key in contact with the hammer member as a fulcrum, and so the lower deformation restricting section of the key comes in contact with the upper surface of the keyboard chassis, whereby the downward elastic deformation of the bendable section is restricted. As a result, damage to the bendable section can be prevented.

However, in the conventional keyboard device, the portion of the upper deformation restricting section of the key which comes in contact with the undersurface of the keyboard chassis when the front portion of the key is depressed, and the portion of the lower deformation restricting section of the key which comes in contact with the upper surface of the keyboard chassis when the rear portion of the key is depressed are formed to be shifted from each other in the front-back direction of the key, and therefore the rotation fulcrum of the key differs in the front-back direction between when the front portion of the key is depressed and when the rear portion of the key is depressed. Accordingly, there is a problem in that the rotation movement of the keys is not always constant and a sense of incongruity can occur during key pushing operations.

The present invention has been conceived to solve the above-described problems, and an object of the present invention is to provide a keyboard device that holds the rotation fulcrum of a key stable regardless of whether the front portion of the key is being depressed or the rear portion of the key is being depressed, which ensures the durability of the bendable section, stabilizes the rotation movement of the keys and favorably performs key pushing operations.

SUMMARY OF THE INVENTION

In accordance with one aspect of the present invention, there is provided a keyboard device comprising: a keyboard chassis; a plurality of keys which are arranged on the keyboard chassis and rotate in an up and down direction by bending a bendable section located in a rear portion of each of the keys; a first supporting section which is formed anterior to the bendable section of the key and in a lower portion of the key, and whose lower end portion is held slidably in contact with the keyboard chassis; and a second supporting section which is formed in an upper portion of the key corresponding to the first supporting section, and whose upper end portion is held slidably in contact with the keyboard chassis.

In accordance with another aspect of the present invention, there is provided a keyboard device comprising: a keyboard chassis, a plurality of keys which are arranged on the keyboard chassis and rotate in an up and down direction by bending a bendable section located in a rear portion of each of the keys; a locking section which is formed in the keyboard chassis; and a hook section which is formed anterior to the bendable section of the key, and rotatably interlocks with the locking section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

First Embodiment

A first embodiment in which the present invention has been applied to a keyboard instrument will hereinafter be described with reference to FIG. 1 to FIG. 3.

Figure 1:
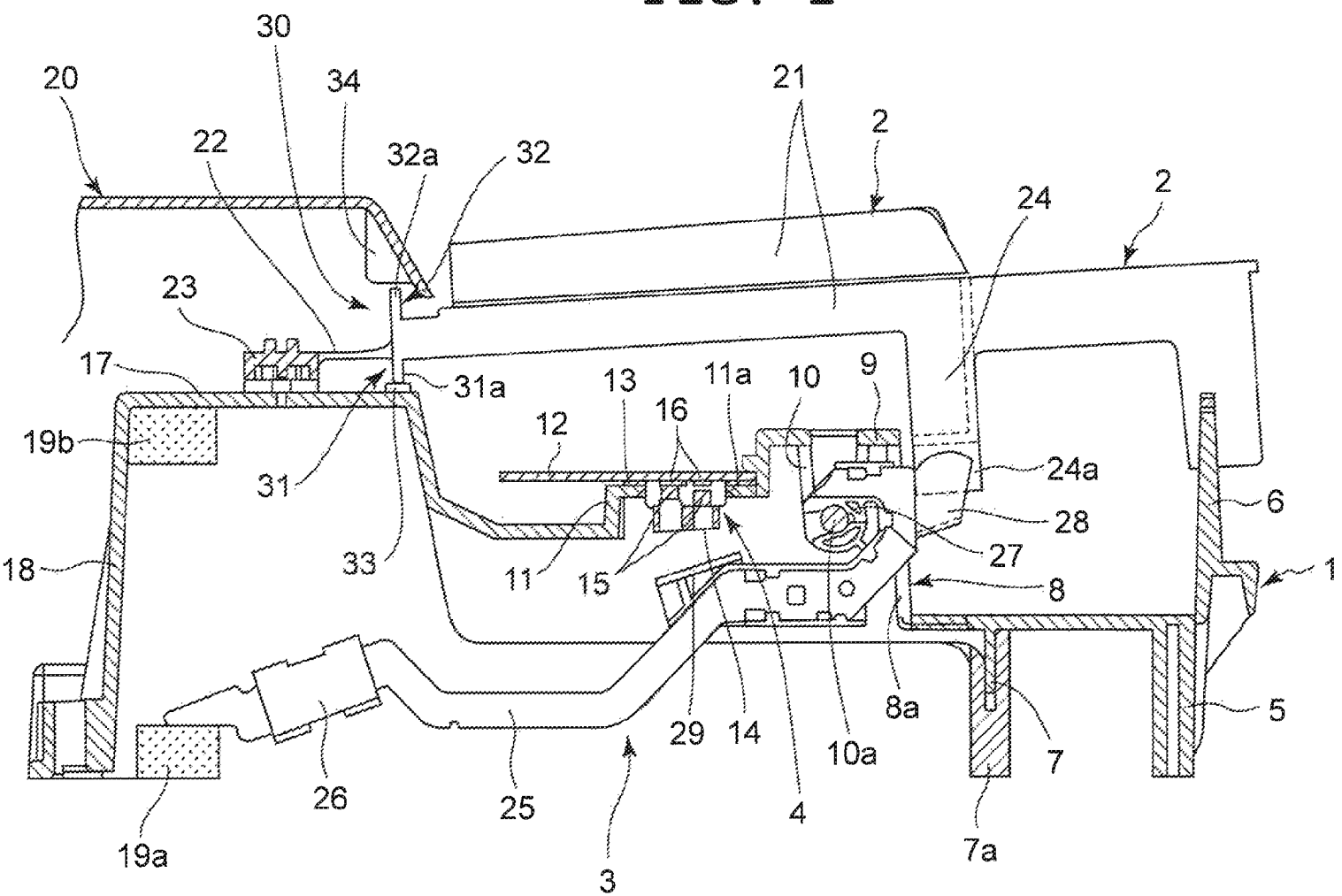
FIG. 1 is a cross-sectional view showing a first embodiment in which the present invention has been applied to a keyboard instrument.
Figure 2:
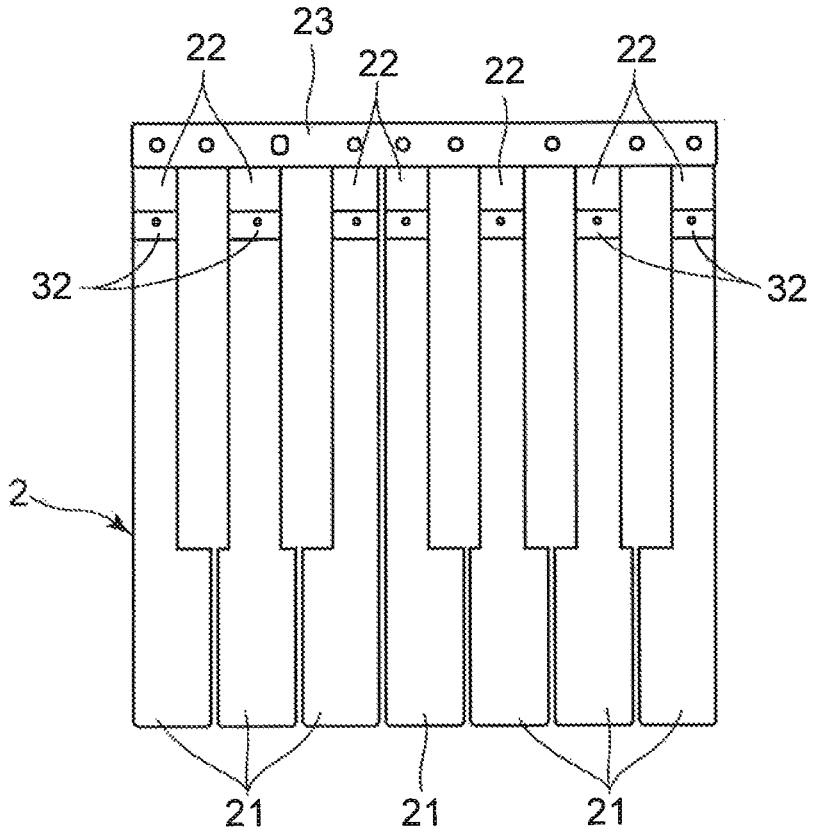
FIG. 2 is a planar view of keys of the keyboard instrument in FIG. 1, which is showing the arrangement of the keys.

As shown in FIG. 1 and FIG. 2, the keyboard instrument includes a keyboard chassis 1 made of synthetic resin, a plurality of keys 2 arranged on the keyboard chassis 1 in a manner to be rotatable in an up and down direction, a plurality of hammer members 3 which apply action load to the plurality of keys 2, and a plurality of switch sections 4 which are turned ON by rotation movements of the plurality of hammer members 3.

As shown in FIG. 1, the keyboard chassis 1 is structured such that a front leg portion 5 is provided in the front end area (right end area in FIG. 1) thereof, projecting upwards from the bottom. In addition, a key guide section 6 for preventing horizontal movement of the key 2 is provided erecting from the upper front of the front leg portion 5, and an intermediate leg portion 7 is provided on a portion of the keyboard chassis 1 which is in back of (left side in FIG. 1) the front leg portion 5.

Moreover, as shown in FIG. 1, a rubber leg 7*a* is provided over the intermediate leg portion 7 so as to be the same height as the front leg portion 5. In addition, a rising section 8 is provided upright in upper back (upper left in FIG. 1) of the intermediate leg portion 8 so as to be almost the same height as the key guide section 6. An opening section 8*a* for hammer insertion is provided in this rising section 8, and the front portion (right side portion in FIG. 1) of the hammer member 3 described hereafter is inserted into the opening section 8*a* and moves in the up and down direction.

Furthermore, as shown in FIG. 1, a hammer mounting section 9 is provided above the rising section 8 so as to be almost horizontal towards the rear side (left side in FIG. 1). In addition, a hammer supporting section 10 projecting downwards is provided below the hammer mounting section 9, and a supporting shaft 10*a* that rotatably supports the hammer member 3 is provided in the hammer supporting section 10.

Still further, as shown in FIG. 1, a board mounting section 11 is provided in back (left side in FIG. 1) of the hammer mounting section 9, which is positioned a step lower than the hammer mounting section 9. On this board mounting section 11, a switch board 12 is provided consecutively along the array direction of the keys 2, and the switch sections 4 are provided on the undersurface of the switch board 12 so as to correspond to the hammer members 3, respectively.

The switch section 4 provided on the undersurface of the switch board 12 has a dome-shaped bulging section 14 which is formed bulging from a rubber sheet 13 and inserted into an opening section ha of the board mounting section 11 from above to project downwards, as shown in FIG. 1. This switch section 4 is structured such that a pair of movable contacts 15 are provided within the dome-shaped bulging section 14 of the switch section 4, and outputs an ON signal as a result of the pair of movable contacts 15 successively coming in contact with a pair of fixed contacts provided on the undersurface of the switch board 12 with a time delay.

As shown also in FIG. 1, a key mounting section 17 is provided in the rear of the keyboard chassis 1 and positioned in back (left side in FIG. 1) of the board mounting section 11 so as to be at a height slightly higher than the key guide section 6. This key mounting section 17 is structured such that the rear end portion of the key 2 is attached to the top surface thereof, and a rear leg portion 18 formed downward toward the bottom portion is provided in the rear of the key mounting section 17.

As shown also in FIG. 1, a lower-limit stopper section 19*a* for setting a lower-limit position of the hammer member 3 is provided near the lower end of the rear leg portion 18, and an upper-limit stopper section 19*b* for setting an upper-limit position of the hammer member 3 is provided on the undersurface of the key mounting section 17 positioned on top of the rear leg portion 18. In addition, an upper case 20 in which various electronic components (not shown), such as a speaker, required in the keyboard instrument are assembled is attached to the rear portion of the keyboard chassis 1 to cover and hide the rear portions (left side portions in FIG. 1) of the keys 2.

Although only white keys will be described in the first embodiment, the keys 2 are composed of the white keys and black keys, as shown in FIG. 1. As shown in FIG. 1 and FIG. 2, each key 2 is structured such that a thin bendable section 22 that is bendable in the up and down direction is integrally formed in the rear (left side in FIG. 1) of a key main body 21. This bendable section 22 is connected to a connecting section 23 that is provided consecutively in the array direction (left-right direction in FIG. 2) of the keys 2.

These keys 2 are structured such that the key main bodies 21 are arrayed in the order of a musical scale by the connecting section 23, as shown in FIG. 2. In each key 2, the connecting section 23 is arranged on the key mounting section 17 of the keyboard chassis 1 and fixed thereto with screws, as shown in FIG. 1. As a result, the key main body 21 is attached to the keyboard chassis 1 in a manner to be rotatable in the up and down direction by bending the bendable section 22. Also, in each key 2, a hammer pressing section 24 projecting downward is provided to press the hammer member 3.

The hammer member 3 includes a hammer main body 25, a weight section 26 provided in the rear area (left side area in FIG. 1) of the hammer main body 25, a bearing section 27 provided in the upper front area (upper right area in FIG. 1) of the hammer main body 25 and serving as the rotational center of the hammer main body 25, a key contacting section 28 provided in the front end area (left end area in FIG. 1) of the hammer main body 25, and a switch pressing section 29 provided in the intermediate area of the hammer main body 25, as shown in FIG. 1.

As shown in FIG. 1, the hammer member 3 is structured such that the key contacting section 28 of the hammer main body 25 is inserted into an opening section 8*a* of the rising section 8 from below the keyboard chassis 1 and protrude from the front side (right side in FIG. 1) of the hammer mounting section 9, and the bearing section 27 of the hammer main body 25 is rotatably attached to the supporting shaft 10*a* of the hammer supporting section 10 of the hammer mounting section 9, whereby the hammer main body 25 rotates in the up and down direction around the supporting shaft 10*a* of the hammer supporting section 10.

The hammer member 3 is also structured such that, when the bearing section 27 of the hammer main body 25 is rotatably attached to the supporting shaft 10*a* of the hammer supporting section 10, the key contacting section 28 of the hammer main body 25 is slidably inserted into the hammer holding section 24*a* of the hammer pressing section 24 of the key 2, as shown in FIG. 1. As a result, when the key contacting section 28 is pressed downwards by the hammer pressing section 24 of the key 2 in response to a key pushing operation of the key 2, the hammer main body 25 rotates in the clockwise direction around the supporting shaft 10*a* of the hammer supporting section 10, as shown in FIG. 3.

The hammer member 3 is also structured such that, in an initial state where the key 2 has not been depressed, the hammer main body 25 rotates in the counter-clockwise direction around the supporting shaft 10*a* of the hammer supporting section 10 by the weight of the weight section 26, whereby the rear end portion of the hammer main body 25 comes in contact with the lower-limit stopper section 19*a* provided in the keyboard chassis 1 so as to be restricted to the lower-limit position which is its initial position, and the key contacting section 28 presses the hammer pressing section 24 of the key 2 upwards to restrict the key 2 in its initial position, as shown in FIG. 1.

Figure 3:
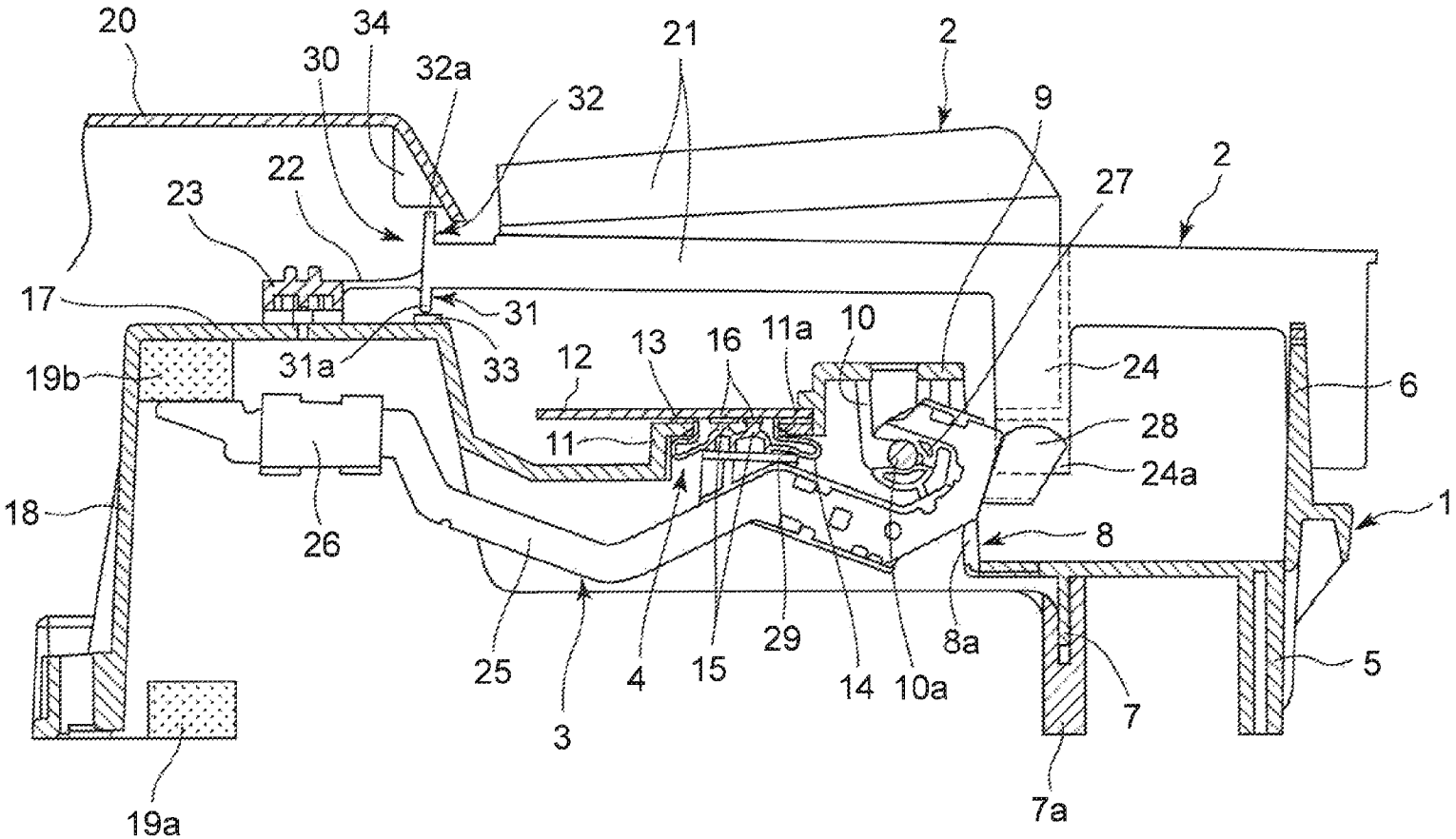
FIG. 3 is a cross-sectional view showing the keyboard instrument in FIG. 1, in which a key has been depressed.

The hammer member 3 is also structured such, when the key 2 is depressed, the key contacting section 28 of the hammer main body 25 is pressed downwards against the weight of the weight section 26 by the hammer pressing section 24 of the key 2, whereby the hammer main body 25 rotates in the clockwise direction around the supporting shaft 10*a* of the hammer supporting section 10, applying action load to the key 2, as shown in FIG. 3.

The hammer member 3 is also structured such, when the hammer main body 25 rotates in the clockwise direction around the supporting shaft 10*a* of the hammer supporting section 10, the switch pressing section 29 of the hammer main body 25 presses the switch section 4 on the switch board 12 to operate the switch section 4, and the rear end portion of the hammer main body 25 comes in contact with the upper-limit stopper section 19*b* provided on the undersurface of the key mounting section 17 of the keyboard chassis 1 so as to restrict the hammer main body 25 to its upper-limit position, whereby the key 2 is restricted to its lower-limit position, as shown in FIG. 3.

As shown in FIG. 1, the key 2 includes a key rotation holding section 30 for holding the rotation fulcrum stable when the key 2 rotates in the up and down direction as a result of the bendable section 22 provided in the rear (left side in FIG. 1) thereof being bent. The key rotation holding section 30 includes a first supporting section 31 formed in the lower portion of the key main body 21 that is positioned further to the front of the key 2 than the bendable section 22, and a lower end portion 31*a* of this first supporting section 31 is held slidably in contact with the keyboard chassis 1. The key rotation holding section 30 also includes a second supporting section 32 formed in the upper portion of the key main body 21 corresponding to the first supporting section 31, and an upper end portion 32*a* of this second supporting section 32 is held slidably in contact with the keyboard chassis 1.

In this instance, the first supporting section 31 is formed on the undersurface of the rear end portion of the key main body 21 positioned in the front end (right end in FIG. 1) of the bendable section 22, projecting almost vertically downwards, as shown in FIG. 1 and FIG. 3. The lower end portion 31*a* of this first supporting section 31 is structured to be in slidable contact with a first receiving section 33 provided on the top surface of the key mounting section 17 of the keyboard chassis 1.

The second supporting section 32 is formed on the top surface of the rear end portion of the key main body 21 positioned in the front end (right end in FIG. 1) of the bendable section 22, projecting almost vertically upwards, as shown in FIG. 1 and FIG. 3. The upper end portion 32*a* of this second supporting section 32 is structured to be in slidable contact with a second receiving section 34 provided on the inner surface of the front portion (right side portion in FIG. 1) of the upper case 20 attached to the keyboard chassis 1.

Next, the mechanism of this keyboard instrument will be described.

First, in the initial state where the key 2 has not been depressed, the hammer main body 25 of the hammer member 3 rotates in the counter-clockwise direction around the supporting shaft lfla of the hammer supporting section 10 of the keyboard chassis 1 by the weight of the weight section 26, whereby the rear end portion of the hammer main body 25 comes in contact with the lower-limit stopper section 19*a* provided near the lower end of the rear leg portion 18 of the keyboard chassis 1, and thereby restricted to its lower-limit position, as shown in FIG. 1.

In this state, the switch pressing section 29 of the hammer member 3 is positioned away in the downward direction from the switch section 4 provided on the switch board 12, and therefore the pair of movable contacts 15 provided within the dome-shaped bulging section 14 of the switch section 4 is positioned away from the pair of fixed contacts 16 provided on the undersurface of the switch board 12. As a result, the switch section 4 is in an OFF state.

In addition, the hammer pressing section 24 of the key 2 has been pressed upwards by the key contacting section 28 of the hammer member 3, and therefore the front end portion of the key main body 21 pressed upward is being restricted to the upper-limit position which is its initial position, in the state of being supported by the bendable section 22 and the key rotation holding section 30 of the key 2, as shown in FIG. 1.

When the key 2 is depressed in this state, the key main body 21 rotates in the clockwise direction around the key rotation holding section 30 of the key 2 while bending the bendable section 22, and the hammer pressing section 24 of the key 2 presses the key contacting section 28 of the hammer member 3 downwards, as shown in FIG. 1 and FIG. 3. When the hammer pressing section 24 of the key 2 presses the key contacting section 28 of the hammer member 3 downwards against the weight of the weight section 26 of the hammer main body 25, the hammer main body 25 rotates in the clockwise direction around the supporting shaft 10*a* of the hammer supporting section 10 of the keyboard chassis 1 and action load is applied to the key 2.

If the front portion of the key 2 positioned further to the front of the key 2 than the area where the hammer pressing section 24 of the key 2 comes in contact with the key contacting section 28 of the hammer member 3 has been depressed when the key main body 21 rotates in the clockwise rotation in response to a key pushing operation, the rear portion of the key main body 21 is pressed upwards with the area where the hammer pressing section 24 of the key 2 comes in contact with the key contacting section 28 of the hammer member 3 serving as a fulcrum. Accordingly, the upper end portion 32*a* of the second supporting section 32 of the key rotation holding section 30 of the key 2 is pressed upwards against the second receiving section 34 provided in the upper case 20.

In this state, the key main body 21 rotates in the clockwise direction around the upper end portion 32*a* of the second supporting section 32 while bending the bendable section 22 of the key 2, and the lower end portion 31*a* of the first supporting section 31, which is in contact with the first receiving section 33, slides slightly forward along the top surface of the first receiving section 33 provided on the key mounting section 17 of the keyboard chassis 1. As a result, the rotation movement of the key 2 will always remain stable.

On the other hand, if the rear portion of the key 2 positioned further to the rear of the key 2 than the area where the hammer pressing section 24 of the key 2 comes in contact with the key contacting section 28 of the hammer member 3 is depressed, the rear portion of the key main body 21 is pressed downwards with the area where the hammer pressing section 24 of the key 2 comes in contact with the key contacting section 28 of the hammer member 3 serving as a fulcrum. Accordingly, the lower end portion 31*a* of the first supporting section 31 of the key rotation holding section 30 of the key 2 is pressed against the first receiving section 33 provided on the key mounting section 17 of the keyboard chassis 1.

In this state, the key main body 21 rotates in the clockwise direction around the lower end portion 31*a* of the first supporting section 31 while bending the bendable section 22, and the upper end portion 32*a* of the second supporting section 32, which is in contact with the second receiving section 34, slides slightly forward along the undersurface of the second receiving section 34 provided in the upper case 20. As a result, the rotation movement of the key 2 will always remain stable.

When the key 2 is depressed and the hammer member 3 rotates as described above, the switch pressing section 29 of the hammer member 3 presses the switch section 4 of the switch board 12 provided in the board mounting section 11 of the keyboard chassis 1, and the switch section 4 is turned ON, as shown in FIG. 3. That is, in the switch section 4, when the dome-shaped bulging section 14 is pressed by the switch pressing section 29 of the hammer member 3, the bulging section 14 elastically deforms such as to be squashed, and the movable contacts 15 inside the bulging section 14 successively come in contact with the fixed contacts 16 on the switch board 12 with a time delay, whereby the switch section 4 outputs a switch signal.

Then, when the key 2 is further depressed and the hammer member 3 is further rotated, as shown in FIG. 3, the rear end portion of the hammer main body 25 comes in contact with the upper-limit stopper section 19*b* provided in the key mounting section 17 of the keyboard chassis 1, whereby the rotation of the hammer member 3 in the clockwise direction is stopped, and the hammer member 3 is restricted to its upper-limit position. In addition, the rotation of the key 2 in the clockwise direction is stopped, and the key 2 is restricted to its lower-limit position.

Subsequently, the hammer member 3 rotates in the counter-clockwise direction around the supporting shaft 10*a* of the hammer supporting section 10 by the weight of the weight section 26 of the hammer main body 25 and returns to its initial position as shown in FIG. 1. When the hammer main body 25 of the hammer member 3 rotates in the counter-clockwise direction around the supporting shaft 10*a* of the hammer supporting section 10 of the keyboard chassis 1 by the weight of the weight section 26, the rear end portion of the hammer main body 25 comes in contact with the lower-limit stopper section 19*a* provided near the lower end of the rear leg portion 18 of the keyboard chassis 1, and thereby restricted to the lower-limit position which is its initial position.

At this time, the switch pressing section 29 of the hammer member 3 is separated in the downward direction from the switch section 4 provided on the switch board 12. Accordingly, the pair of movable contacts 15 provided inside the dome-shaped bulging section 14 of the switch section 4 is separated from the pair of fixed contacts 16 provided on the undersurface of the switch board 12, whereby the switch section 4 is turned OFF.

In addition, the hammer pressing section 24 of the key 2 is pressed upwards by the key contacting section 28 of the hammer member 3, whereby the key main body 21 rotates in the counter-clockwise direction around the key rotation holding section 30 of the key 2 while bending the bendable section 22, and the front end portion of the key main body 21 is pressed upwards and restricted to the upper-limit position which is its initial position, as shown in FIG. 1.

As described above, this keyboard instrument includes the keyboard chassis 1, the keys 2 which are arranged on the keyboard chassis 1 and each of which rotates in the up and down direction by the bending of the bendable section 22 positioned in the rear, and the key rotation holding section 30 for holding the rotation fulcrum of the key 2 stable when the key 2 rotates in the up and down direction. Therefore, the rotation fulcrum of the key 2 is kept stable by the key rotation holding section 30 regardless of whether the front portion of the key 2 is being depressed or the rear portion of the key 2 is being depressed, whereby the key 2 can be rotated steadily at all times. As a result, the durability of the bendable section 22 is ensured, the rotation movement of the key 2 will remain stable and which favorably performs key pushing operations.

That is, the key rotation holding section 30 includes the first supporting section 31 which is formed in the lower portion of the key 2 that is positioned further to the front of the key 2 than the bendable section 22 and whose lower end portion 31*a* is held slidably in contact with the keyboard chassis 1, and the second supporting section 32 which is formed in the upper portion of the key 2 corresponding to the first supporting section 31 and whose upper end portion 32*a* is held slidably in contact with the keyboard chassis 1. Accordingly, when depressed, the key 2 can be rotated around the lower end portion 31*a* of the first supporting section 31 or the upper end portion 32*a* of the second supporting section 32.

As a result, since the rotation fulcrum of the key 2 can be kept stable, the key 2 can always be rotated in a constant state. Therefore, regardless of whether the front portion of the key 2 is being depressed or the rear portion of the key 2 is being depressed, the bending deformation of the bendable section 22 will be kept stable, whereby stress concentration on the bendable section 22 can be prevented, the durability of the bendable section 22 is enhanced, and the rotation movement of the key 2 will always remain stable. Therefore, key pushing operations of the key 2 are favorably performed without a sense of incongruity occurring during key pushing operations.

In this instance, the lower end portion 31*a* of the first supporting section 31 is in slidable contact with the first receiving section 33 provided on the key mounting section 17 of the keyboard chassis 1, and the upper end portion 32*a* of the second supporting section 32 is in slidable contact with the second receiving section 34 provided on the inner surface of the upper case 20 attached to the keyboard chassis 1. Therefore, when the key 2 is being rotated by a key pushing operation, the rotation fulcrum of the key 2 will be held stable without a large load being applied to the bendable section 22, regardless of whether the front portion of the key 2 is being depressed or the rear portion of the key 2 is being depressed. As a result, stress concentration on the bendable section 22 can be prevented, and the rotation movement of the key 2 will always remain stable.

For example, when the front portion of the key 2 is depressed and the back portion of the key main body 21 is pressed upwards, the second supporting section 32 rotates centering on its upper end portion 32*a*, with this upper end portion 32*a* being in contact with the second receiving section 34 provided on the inner surface of the upper case 20. In addition, the lower end portion 31*a* of the first supporting section 31 slides while being in contact with the top surface of the first receiving section 33 on the keyboard chassis 1. Therefore, the rotation fulcrum of the key 2 will be kept stable without a large load being applied to the bendable section 22, whereby stress concentration on the bendable section 22 can be prevented and the rotation movement of the key 2 will always remain stable.

Also, when the rear portion of the key 2 is depressed and the rear portion of the key main body 21 is pressed downwards, the first supporting section 31 rotates centering on its lower end portion 31*a*, with this lower end portion 31*a* being in contact with the first receiving section 33 on the keyboard chassis 1. In addition, the upper end portion 32*a* of the second supporting section 32 slides while being in contact with the undersurface of the second receiving section 34 provided on the inner surface of the upper case 20. Therefore, the rotation fulcrum of the key 2 will be kept stable without a large load being applied to the bendable section 22, whereby stress concentration on the bendable section 22 can be prevented and the rotation movement of the key 2 will always remain stable.

Moreover, in the keyboard instrument, the keyboard chassis 1 is provided with the hammer member 3 that rotates along with a key pushing operation on the key 2 and applies action load to the key 2. Accordingly, the rotation speed of the hammer member 3 differs depending on the depression strength of the key 2, and therefore action loads of different strengths can be applied to the key 2 based on the depression strength of the key 2. As a result, a key touch feeling resembling that of the key touch feeling of an acoustic piano can be achieved.

In this instance, when the front portion of the key 2 is depressed, the rear portion of the key main body 2 is pressed upwards with the area shown in FIG. 1 at which the hammer pressing section 24 of the key 2 comes in contact with the key contacting section 28 of the hammer member 3 serving as a fulcrum, whereby the upper end portion 32*a* of the second supporting section 32 of the key rotation holding section 30 of the key 2 is pressed against the second receiving section 34 provided in the upper case 20.

In this state, the key main body 21 rotates in the clockwise direction around the upper end portion 32*a* of the second supporting section 32 while bending the bendable section 22 of the key 2, and the lower end portion 31*a* of the first supporting section 31 slides along the top surface of the first receiving section 33 provided on the key mounting section 17 of the keyboard chassis 1 while being in contact therewith. Therefore, a large load is not applied to the bendable section 22 by the hammer member 3, and the rotation fulcrum of the key 2 can be kept stable without being affected by the hammer member 3. As a result, stress concentration on the bendable section 22 will be prevented and the key 2 will be favorably rotated in a constant state.

On the other hand, when the rear portion of the key 2 is depressed, the rear portion of the key main body 21 is pressed downwards with the area shown in FIG. 1 at which the hammer pressing section 24 of the key 2 comes in contact with the key contacting section 28 of the hammer member 3 serving as a fulcrum, whereby the lower end portion 31*a* of the first supporting section 31 of the key rotation holding section 30 of the key 2 is pressed against the first receiving section 33 provided on the key mounting section 17 of the keyboard chassis 1.

In this state, the key main body 21 rotates in the clockwise direction around the lower end portion 31*a* of the first supporting section 31 while bending the bendable section 22 of the key 2, and the upper end portion 32*a* of the second supporting section 32 slides along the undersurface of the second receiving section 34 provided in the upper case 20 while being in contact therewith. Therefore, a large load is not applied to the bendable section 22 by the hammer member 3, and the rotation fulcrum of the key 2 will be kept stable without being affected by the hammer member 3. As a result, stress concentration on the bendable section 22 will be prevented and the key 2 the key 2 will be favorably rotated in a constant state.

Second Embodiment

Next, a second embodiment in which the present invention has been applied to a keyboard instrument will be described with reference to FIG. 4 and FIG. 5. Sections and portions that are the same as those of the first embodiment shown in FIG. 1 to FIG. 3 are described using the same reference numerals.

Figure 4:
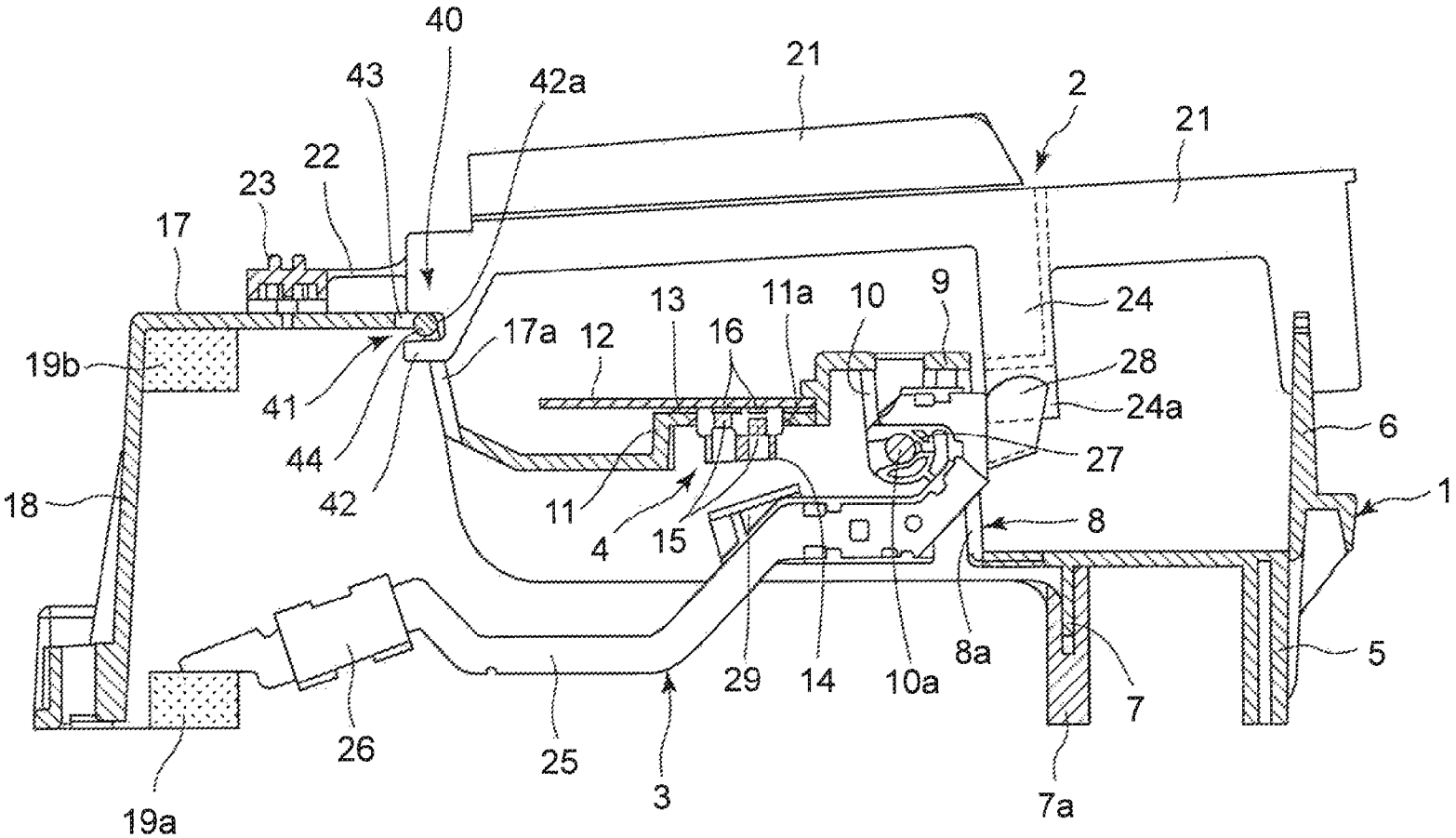
FIG. 4 is a cross-sectional view showing a second embodiment in which the present invention has been applied to a keyboard instrument.

As shown in FIG. 4, the structure of this keyboard instrument is similar to that of the first embodiment except for the structure of a key rotation holding section 40 that holds the rotation fulcrum of the key 2 stable.

Figure 5:
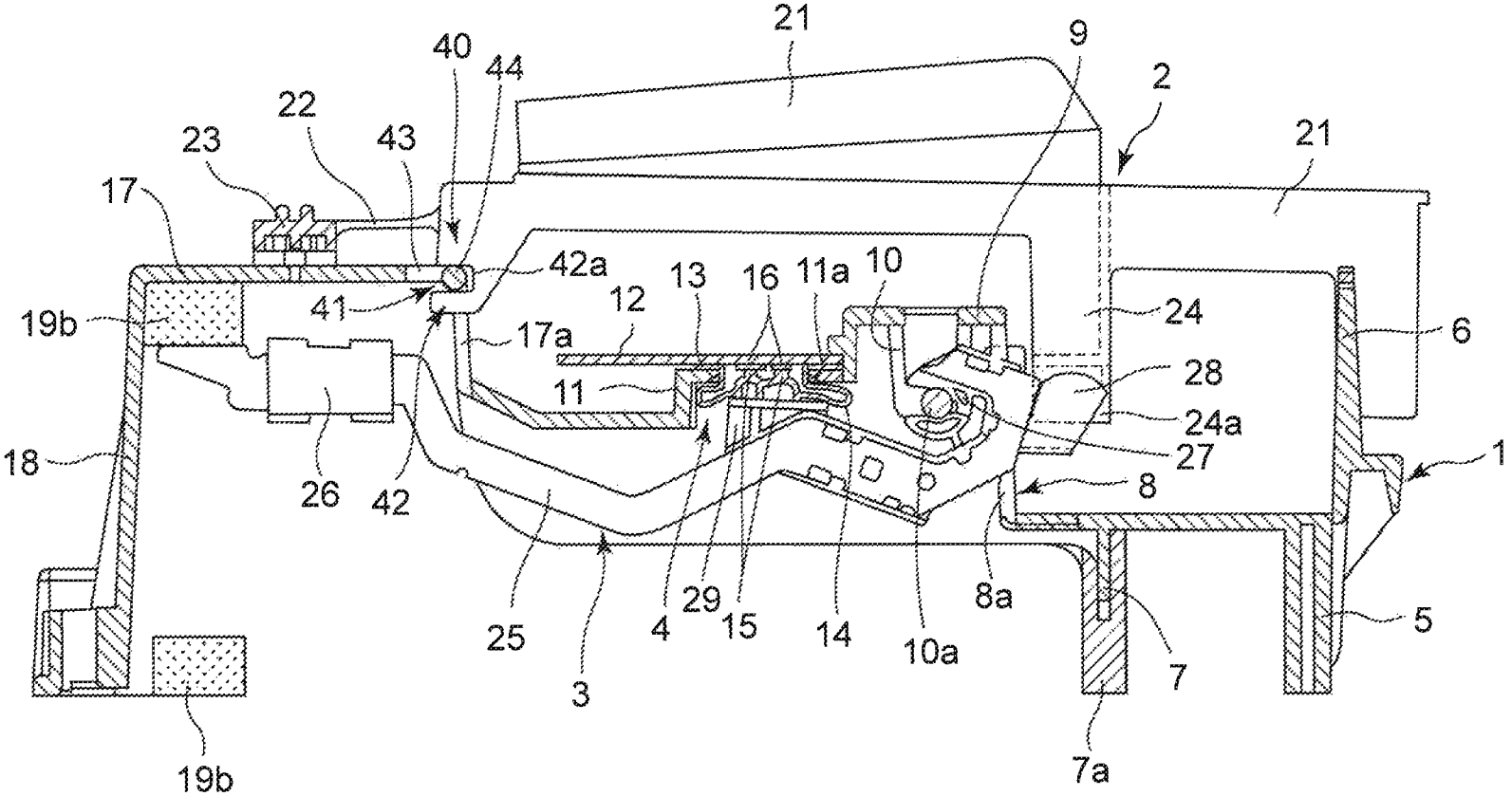
FIG. 5 is a cross-sectional view showing the keyboard instrument in FIG. 4, in which a key has been depressed.

Specifically, as shown in FIG. 4 and FIG. 5, the key rotation holding section 40 includes a locking section 41 provided in the keyboard chassis 1, and a hook section 42 provided in the key main body 21 which is positioned further anterior of the key 2 than the bendable section 22, and rotatably interlocks with the locking section 41. In this instance, an opening section 43 corresponding to the key 2 is formed in a corner of the front side (right side in FIG. 4) of the key mounting section 17 of the keyboard chassis 1, or in other words, in an area between the key mounting section 17 and a dropping section 17*a* positioned on the front side of the key mounting section 17.

The locking section 41 of the key rotation holding section 40 is structured such that a shaft section 44 is provided inside the opening section 43 in the key mounting section 17 of the keyboard chassis 1 along the direction perpendicular to the front-back direction of the key 2, as shown in FIG. 4 and FIG. 5. The hook section 42 is provided projecting downward in the lower area of the rear end portion of the key main body 21 positioned in front (to the right in FIG. 4) of the bendable section 22, and a shaft insertion groove 42*a* that is open towards the rear is provided in the lower area of the projected portion of the hooked section 42.

The lower portion of the hook section 42 corresponds to the dropping section 17*a* in the front area of the key mounting section 17 of the keyboard chassis 1, and the shaft insertion groove 42*a* in this lower portion corresponds to the shaft section 44 positioned in the corner of the key mounting section 17, as shown in FIG. 4 and FIG. 5. As a result of the shaft section 44 of the locking section 41 being moved in relation to the shaft insertion groove 42*a* and inserted thereinto in this state, the shaft section 44 is rotatably held from above and below by the shaft insertion groove 42*a*.

Next, the mechanism of this keyboard instrument will be described.

In the initial state where the key 2 has not been depressed, the hammer main body 25 of the hammer member 3 rotates in the counter-clockwise direction around the supporting shaft 10*a* of the hammer supporting section 10 of the keyboard chassis 1 by the weight of the weight section 26, whereby the rear end portion of the hammer main body 25 comes in contact with the lower-limit stopper section 19*a* provided near the lower end of the rear leg portion 18 of the keyboard chassis 1, and thereby restricted to the lower-limit position which is its initial position, as in the case of the first embodiment.

In this state, the switch pressing section 29 of the hammer member 3 is positioned away in the downward direction from the switch section 4 provided on the switch board 12, and therefore the switch section 4 is in the OFF state. In addition, the hammer pressing section 24 of the key 2 has been pressed upward by the key contacting section 28 of the hammer member 3, and therefore the front end portion of the key main body 21 pressed upward is being restricted to the upper-limit position which is its initial position, in the state of being supported by the bendable section 22 and the key rotation holding section 40 of the key 2.

When the key 2 is depressed in this state, the key main body 21 rotates in the clockwise direction around the key rotation holding section 40 of the key 2 while bending the bendable section 22, and the hammer pressing section 24 of the key 2 presses the key contacting section 28 of the hammer member 3 downwards, as shown in FIG. 4 and FIG. 5. When the hammer pressing section 24 of the key 2 presses the key contacting section 28 of the hammer member 3 downwards against the weight of the weight section 26 of the hammer main body 25, the hammer main body 25 rotates in the clockwise direction around the supporting shaft 10*a* of the hammer supporting section 10 of the keyboard chassis 1 and action load is applied to the key 2, as in the case of the first embodiment.

If the front portion of the key 2 positioned further to the front of the key 2 than the area where the hammer pressing section 24 of the key 2 comes in contact with the key contacting section 28 of the hammer member 3 has been depressed when the key main body 21 rotates in the clockwise rotation in response to a key pushing operation, the rear portion of the key main body 21 is pressed upwards with the area where the hammer pressing section 24 of the key 2 comes in contact with the key contacting section 28 of the hammer member 3 serving as a fulcrum. However, because the key 2 rotates in the up and down direction around the shaft section 44 of the key rotation holding section 40, the bendable section 22 is not pressed upward by the rear portion of the key main body 21 and bends steadily, as shown in FIG. 5.

On the other hand, if the rear portion of the key 2 positioned further to the rear of the key 2 than the area where the hammer pressing section 24 of the key 2 comes in contact with the key contacting section 28 of the hammer member 3 is depressed, the rear portion of the key main body 21 is pressed downwards with the area where the hammer pressing section 24 of the key 2 comes in contact with the key contacting section 28 of the hammer member 3 serving as a fulcrum. However, in this case as well, because the key 2 rotates in the up and down direction around the shaft section 44 of the key rotation holding section 40, the bendable section 22 is not pressed downward by the rear portion of the key main body 21 and bends steadily, as shown in FIG. 5.

That is, in the key rotation holding section 40, the shaft section 44 of the locking section 41 provided in the key mounting section 17 of the keyboard chassis 1 is inserted into the shaft insertion groove 42*a* of the hook section 42 projecting downward from the key 2, and the key 2 rotates in the up and down direction around this shaft section 44. Therefore, the key 2 is stable and rotates in a constant state while steadily bending the bendable section 22 of the key 2, regardless of whether the front portion of the key 2 is being depressed or the rear portion of the key 2 is being depressed.

When the key 2 is depressed and the hammer member 3 rotates as described above, the switch pressing section 29 of the hammer member 3 presses the switch section 4 of the switch board 12 provided in the board mounting section 11 of the keyboard chassis 1, and the switch section 4 is turned ON, as shown in FIG. 5. Then, when the key 2 is further depressed and the hammer member 3 is further rotated, the rear end portion of the hammer main body 25 comes in contact with the upper-limit stopper section 19*b* provided in the key mounting section 17 of the keyboard chassis 1, whereby the hammer member 3 is restricted to its upper-limit position, and the key 2 is restricted to its lower-limit position, as shown in FIG. 5.

Subsequently, the hammer member 3 rotates in the counter-clockwise direction around the supporting shaft 10*a* of the hammer supporting section 10 by the weight of the weight section 26 of the hammer main body 25, and returns to its initial position as shown in FIG. 4, whereby the switch section 4 is turned OFF, and the key 2 is restricted to the upper-limit position which is its initial position, as in the case of the first embodiment.

As described above, this keyboard instrument includes the keyboard chassis 1, the keys 2 which are arranged on the keyboard chassis 1 and each of which rotates in the up and down direction by the bending of the bendable section 22 positioned in the rear, and the key rotation holding section 40 for holding the rotation fulcrum of the key 2 stable when the key 2 rotates in the up and down direction. Therefore, the rotation fulcrum of the key 2 is kept stable by the key rotation holding section 40 regardless of whether the front portion of the key 2 is being depressed or the rear portion of the key 2 is being depressed, whereby the key 2 can be rotated steadily at all times. As a result, the durability of the bendable section 22 is ensured, the rotation movement of the key 2 is stable and favorably performs key pushing operations.

That is, since the key rotation holding section 40 includes the locking section 41 provided in the key mounting section 17 of the keyboard chassis 1, and the hook section 42 provided in the key main body 21 which is positioned further to the front of the key 2 than the bendable section 22, and rotatably interlocks with the locking section 41 of the key mounting section 17, the key 2 can be rotated around the locking section 41 of the key mounting section 17 when the key 2 is depressed.

As a result, the rotation fulcrum of the key 2 will be kept stable, whereby the key 2 can be steadily rotated in the up and down direction at all times. Therefore, regardless of whether the front portion of the key 2 is being depressed or the rear portion of the key 2 is being depressed, the bending deformation of the bendable section 22 is stable, whereby stress concentration on the bendable section 22 can be prevented, the durability of the bendable section 22 is enhanced, and the rotation movement of the key 2 will always remain stable. Therefore, key pushing operations can be favorably performed without a sense of incongruity occurring during occurring during key pushing operations.

In this instance, the locking section 41 is structured such that the shaft section 44 is provided inside the opening section 43 formed in a portion of the key mounting section 17 of the keyboard chassis 1 which corresponds to the key 2, along the direction perpendicular to the front-back direction of the key 2. In addition, the hook section 42 is provided projecting downward in the lower portion of the key 2, and inserted into the opening section 43 of the key mounting section 17 of the key chassis 1 to rotatably hold the shaft section 44 from above and below. Accordingly, when the key 2 is depressed, the key 2 is rotated with the hook section 42 of the key 2 holding the shaft section 44 of the locking section 41 of the key mounting section 17 of the keyboard chassis 1 from above and below.

As a result, the key 2 rotates around the shaft section 44 of the locking section 41 provided in the key mounting section 17 of the keyboard chassis 1 regardless of whether the front portion of the key 2 is being depressed or the rear portion of the key 2 is being depressed, whereby the rotation state of the key 2 can be kept steady. Therefore, the bendable section 22 can be bent steadily at all times without a large load being applied thereto, and accordingly stress concentration on the bendable section 22 can be prevented and the rotation movement of the key 2 will always remain stable.

Moreover, in this keyboard instrument as well, the keyboard chassis 1 is provided with the hammer member 3 that rotates along with a depression operation on the key 2 and applies action load to the key 2. Accordingly, as in the case of the first embodiment, the rotation speed of the hammer member 3 differs depending on the depression strength of the key 2, and therefore action loads of different strengths can be applied to the key 2 based on the depression strength of the key 2. As a result, a key-press feel similar to that of an acoustic piano can be achieved.

In this instance, the key 2 can be rotated around the shaft section 44 of the locking section 41 of the key mounting section 17 both when the front portion of the key 2 is depressed and the rear portion of the key main body 2 is pressed upward thereby, and when the rear portion of the key 2 is depressed and the rear portion of the key main body 21 is pressed downward thereby. Accordingly, the bendable section 22 is not affected by the hammer member 3, and a large load is not applied to the bendable section 22. Therefore, stress concentration on the bendable section 22 can be prevented, and the rotation fulcrum of the key 2 will be kept stable, whereby the rotation movement of the key 2 will always remain stable.

In the second embodiment described above, the locking section 41 of the key rotation holding section 40 is integrally formed in the key mounting section 17 of the keyboard chassis 1. However, the present invention is not limited thereto, and the locking section 41 of the key rotation holding section 40 which has been formed separately from the keyboard chassis 1 may be provided in the key mounting section 17 of the keyboard chassis 1.

Moreover, in the above-described first and second embodiments, the switch is operated by the switch pressing section 29 of the hammer member 3 pressing the switch section 4 provided on the undersurface of the switch board 12. However, the present invention is not limited thereto, and a structure may be adopted in which the switch section 4 is provided on the top surface of the switch board 12, a switch pressing section is provided on a portion of the key 2 which corresponds to the switch section 4, and the switch is operated by this switch pressing section provided on the key 2 pressing the switch section 4.

Furthermore, in the above-described first and second embodiments, the present invention has been applied to a keyboard device including the hammer member 3. However, the present invention is not necessarily required to be applied to a keyboard device including the hammer member 3, and may be applied to a keyboard device that does not include the hammer member 3.

While the present invention has been described with reference to the preferred embodiments, it is intended that the invention be not limited by any of the details of the description therein but includes all the embodiments which fall within the scope of the appended claims.

What is claimed is:

1. A keyboard device comprising:

a keyboard chassis;

a plurality of keys which are arranged on the keyboard chassis and are rotatable in an up and down direction by bending a bendable section located in a rear portion of each of the keys;

a locking section which is formed in the keyboard chassis; and a hook section which is formed anterior to the bendable section of each of the keys, and rotatably interlocks with the locking section, wherein the locking section includes (a) an opening section provided in a position of the keyboard chassis corresponding to each of the keys and (b) a shaft section provided along a direction perpendicular to a front-back direction of the key; and wherein the hook section extends from a lower portion of the key, is inserted into the opening section of the keyboard chassis, and rotatably interlocks with the shaft section from above and below.

2. The keyboard device according to claim 1, wherein the keyboard chassis is provided with hammer members that apply an action load on the keys by rotating along with a key pushing operation.

* * * * *